US011779973B2

(12) United States Patent
Bohland et al.

(10) Patent No.: US 11,779,973 B2
(45) Date of Patent: Oct. 10, 2023

(54) ROLLING MILL FOR ROLLING METAL PRODUCTS

(71) Applicant: SMS group GmbH, Düsseldorf (DE)

(72) Inventors: Michael Bohland, Hilchenbach (DE); Dominic Klinker, Freudenberg (DE)

(73) Assignee: SMS group GmbH, Düsseldorf (DE)

( * ) Notice: Subject to any disclaimer, the term of this patent is extended or adjusted under 35 U.S.C. 154(b) by 174 days.

(21) Appl. No.: 17/434,130

(22) PCT Filed: Jan. 16, 2020

(86) PCT No.: PCT/EP2020/050973
§ 371 (c)(1),
(2) Date: Aug. 26, 2021

(87) PCT Pub. No.: WO2020/173614
PCT Pub. Date: Sep. 3, 2020

(65) Prior Publication Data

US 2022/0143660 A1 May 12, 2022

(30) Foreign Application Priority Data

Feb. 28, 2019 (DE) ..... 10 2019 202 691.5

(51) Int. Cl.
*B21B 31/32* (2006.01)
*B21B 31/20* (2006.01)

(52) U.S. Cl.
CPC ..... *B21B 31/203* (2013.01); *B21B 31/32* (2013.01)

(58) Field of Classification Search
CPC ..... B21B 31/02; B21B 31/028; B21B 31/20; B21B 31/22; B21B 31/203; B21B 31/32
See application file for complete search history.

(56) References Cited

U.S. PATENT DOCUMENTS 1,727,122 A * 9/1929 Keller ..... B21B 31/203 72/246
3,626,738 A * 12/1971 Diolot ..... B21B 31/32 72/245

(Continued)

FOREIGN PATENT DOCUMENTS

CN 102085533 B 6/2013
CN 102085532 B 7/2013

(Continued)

OTHER PUBLICATIONS

JP 51-13352 A, Kajiwara et al. Feb. 1976.*

(Continued)

*Primary Examiner* — Edward T Tolan
(74) *Attorney, Agent, or Firm* — Maier & Maier, PLLC

(57) ABSTRACT

A rolling mill for rolling metal products, comprising two roller stands with a stand cross-member. A roller is rotatably mounted in the roller stands. The roller is operatively connected to a balancing cross-member, and at least one hydraulic piston-cylinder system is arranged in the stand cross-member, with which a tensile force can be generated between the stand cross-member and the balancing cross-member by the hydraulic piston-cylinder system. In order to prevent leakages in particular in the event of tall mill ascending paths, the piston-cylinder system has a cylinder housing with an upper axial end and a lower axial end. A piston is movably arranged in the cylinder housing, and the piston protrudes beyond the cylinder housing both at the upper axial end as well as at the lower axial end in each operating state.

16 Claims, 2 Drawing Sheets

(56) References Cited

U.S. PATENT DOCUMENTS

| | | | | |
|---|---|---|---|---|
| 3,805,572 | A * | 4/1974 | Busch | B21B 31/106 72/238 |
| 4,976,128 | A * | 12/1990 | Tajima | B21B 31/22 72/244 |
| 8,042,371 | B2 * | 10/2011 | Saupe | B21B 31/203 72/235 |
| 8,544,308 | B2 * | 10/2013 | Hartung | B21B 29/00 72/241.8 |

FOREIGN PATENT DOCUMENTS

| | | | |
|---|---|---|---|
| CN | 103286138 | A | 9/2013 |
| CN | 103286139 | A | 9/2013 |
| CN | 203541082 | U | 4/2014 |
| DE | 21 65 313 | A1 | 7/1973 |
| DE | 10254958 | A1 | 6/2004 |
| EP | 0791410 | A2 | 8/1997 |
| EP | 1 907 143 | B1 | 12/2009 |
| JP | S50156542 | U | 12/1975 |
| JP | S59118209 | A | 7/1984 |
| JP | S6029943 | U | 2/1985 |
| JP | S6215813 | U | 1/1987 |
| JP | H06210331 | A | 8/1994 |
| JP | 2002039115 | A | 2/2002 |

OTHER PUBLICATIONS

EP 1044736 A1, Bravo et al. Oct. 2000.*
JP 55-161513 A, Masuda et al. Dec. 1980.*
Translation JP 55-161513 A, Masuda et al. Dec. 1980.*
CN 203541082 U, Wu Apr. 2014.*
International Search Report (with English translation) and Written Opinion (with Machine translation) dated Apr. 6, 2020 in corresponding International Application No. PCT/EP2020/050973; 15 pages.
Office Action dated Aug. 10, 2022 in connection with corresponding Japanese Application No. 2021-545776; 8 pages including English-language translation.

* cited by examiner

ROLLING MILL FOR ROLLING METAL PRODUCTS

FIELD

The invention relates to a rolling mill for rolling metal products, comprising two roller stands with a stand cross-member, wherein a roller is rotatably mounted in the roller stands, wherein the roller is operatively connected to a balancing cross-member, and wherein at least one hydraulic piston-cylinder system is arranged in the stand cross-member, with which a tensile force can be generated between the stand cross-member and the balancing cross-member by means of the hydraulic piston-cylinder system.

BACKGROUND

A generic rolling mill is known, for example, from DE 21 65 313 A1. The upper rollers in the rolling mill must be pulled or balanced against the adjustment system by a balancing system. This allows the upper rollers to be moved or positioned in the rolling mill. In addition, games in employment are eliminated by balancing.

According to this, it is known that roll balancers are used in rolling mills. The previously known concept is characterized by a hydraulic cylinder which is arranged in the center of the cross-member and has a classic structure. The cylinder engages the components to be balanced via a cross-member and a balancing cross-member.

Solutions are also known in which four cylinders are used, which engage the components directly through bores in the upper crossheads of the stand. Solutions with two cylinders are also known, but they have a classic structure. Differential cylinders or classic plunger cylinders are used here.

In the CN 102085533 B, two classic plunger cylinders with cross-members arranged in the stand cross-member are used, whereby a balancing cross-member is connected to the cross-member via pull rods. The stability of the system is relatively poor, particularly with tall mill ascending paths. In this solution, a lock is provided which, however, is exposed and therefore has to be shielded for safety reasons.

The CN 103 286 138 A provides for two classic differential cylinders attached to the outside of the scaffolding on additional brackets, which are directly connected to a balancing cross-member. The CN 103 286 139 A rests on two classic differential cylinders attached to the inside of the scaffolding on the stand cross-member.

Another solution with a single piston-cylinder system is shown in JP 59118209 A. Here, too, the problems mentioned arise with tall mill ascending paths.

Further similar solutions are shown in CN 102085532 B and CN 203541082 U. For locking the balancing system, reference is made to EP 1 907 143 B1.

Problems arise with the previously known solutions, in particular with tall mill ascending paths. In this case, the piston-cylinder systems tend to leak or to cause relatively high wear on seals and guide elements. In particular, when the cylinder is arranged in the middle, high forces occur on the cylinder seals, which often results in leaks. Furthermore, high stresses occur in the stand cross-member, especially with wide scaffolding. Because of this, the component must be designed in a complex, heavy and costly manner.

The invention is based on the task of designing a rolling mill of the generic type in such a way that leaks can be better avoided, in particular with tall mill ascending paths. Furthermore, a simple structure of the scaffolding is to be achieved, which can be implemented inexpensively. Finally, the arrangement should also be advantageous from a safety point of view.

SUMMARY

The achievement of this object by the invention is characterized in that the piston-cylinder system comprises a cylinder housing with an upper axial end and a lower axial end, wherein a piston is movably arranged in the cylinder housing and wherein the piston protrudes beyond the cylinder housing in every operating state both at its upper axial end and at its lower axial end.

Two piston-cylinder systems are preferably arranged symmetrically to a central plane of the rolling stands.

According to a preferred embodiment of the invention, the piston has a first external diameter in an upper section, wherein the piston has a second external diameter in a lower section which is smaller than the first external diameter.

The connection between the stand cross-member and the balancing cross-member is preferably established via a pull rod that is connected to the piston and the balancing cross-member. A preferred embodiment of the invention provides that the pull rod axially penetrates the piston and is attached to the piston in an upper region of the latter. The pull rod can be releasably connected to the piston, wherein a locking mechanism is available for the releasable connection.

The locking mechanism is preferably arranged on the cylinder housing (that is to say above the same).

The locking mechanism preferably comprises a pivot drive which, by means of a pivoting movement, causes locking and unlocking.

The locking mechanism furthermore preferably comprises a cover hood which covers the locking mechanism inaccessible from the outside.

The rolling stand is preferably a roughing mill stand or a heavy plate rolling stand in a hot rolling mill. The proposed rolling mill is therefore advantageously used as a roughing mill stand and as a heavy plate stand in hot rolling mills for steel and non-ferrous metals.

The proposed concept reduces the load on the cylinder, especially with regard to its seals and its guide elements, particularly in the case of large mill ascending paths. This leads to a longer service life for the components used.

The seals and guide elements that are used therefore have a longer service life, which results from improved stability. This is achieved by the piston which, as a continuous, rod-shaped element, penetrates the cylinder housing on both sides.

Due to the optimized arrangement of the components, adjacent trades can also be designed much more easily and cost-effectively. The cylinders contain an integrated lock, which means that additional components for a lock can be omitted. Moving parts are not accessible due to the closed design, which means that additional shut-off measures to create the required security are unnecessary. In particular, an integrated or closed construction of the cylinder, pull rod and lock is made possible. This design also enables effective fume extraction.

Finally, a favorable flow of forces is made possible.

This results in an advantageous design with reduced manufacturing costs for the proposed solution.

This advantageously results in an overall increase in the service life of the balancing cylinder, less wear on the seals and guide elements, better stability of the system with large paths, weight and cost savings when balancing, weight and cost savings even with adjacent assemblies, the possibility of a closed platform construction, an integrated lock, no freely accessible moving parts and thus increased operational safety, easy maintenance and exchangeability of the cylinders as well as a flexible arrangement of the components on the scaffolding platform.

Exemplary embodiments of the invention are shown in the drawing. In the figures:

DETAILED DESCRIPTION

Figure 1:
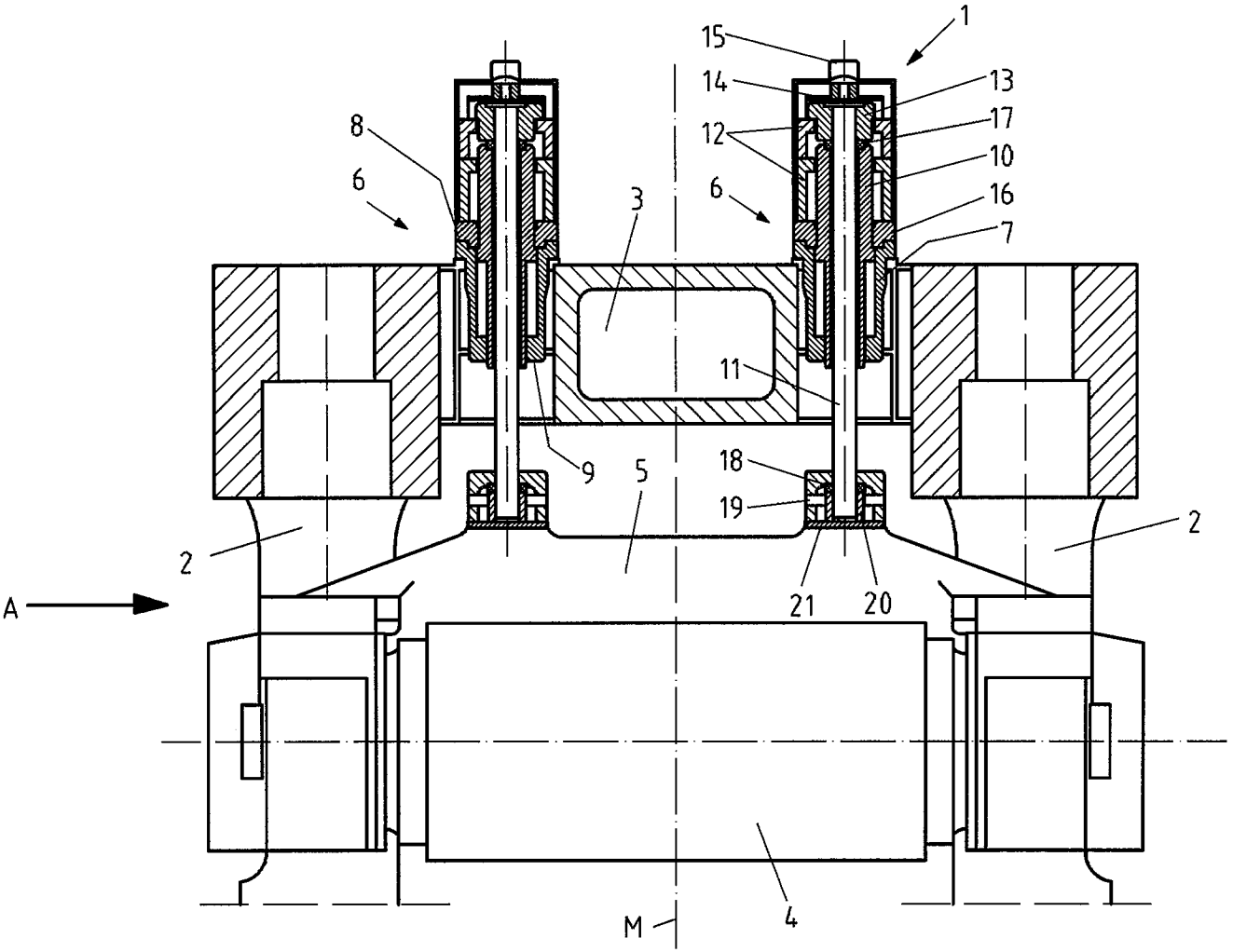
FIG. 1 a rolling mill and specifically the upper part of the same, wherein the rolling direction of the material to be rolled is perpendicular to the plane of the drawing and FIG. 2 the part of the rolling mill according to FIG. 1 seen from the direction "A" as marked in FIG. 1.

In the figures, a rolling mill is 1 to see which comprises at least one, typically two roller stands 2. In the upper area of the rolling mill 1, a stand cross-member 3 is arranged. The roller 4 can be seen in the lower area of the figures (it should be noted here that the rolling mill 1 shown in the figures continues downward, although this is not shown).

Above the roller 4, but below the stand cross-member 3, a balancing cross-member 5 is arranged. This acts indirectly on the roller 4 and exerts balancing forces on it. This technology, which is well known per se, is described in detail in the above-mentioned documents, so that reference is expressly made to it.

The balancing forces are generated by two piston-cylinder systems 6 which—as FIG. 1 shows—are arranged symmetrically to a central plane M of the roller stand 2, but spaced apart from this central plane.

The structure of the piston-cylinder systems 6 and of a locking mechanism 12, 13, 14, 15, with which locking can take place, as described in EP 1 907 143 B1 already mentioned above, can be seen from the figures.

According to this, each piston-cylinder system 6 has a cylinder housing 7 which has an upper axial end 8 and a lower axial end 9. At the upper axial end 8, the cylinder housing 7 is closed by a cylinder cover 16. The cylinder housing 7 is penetrated by a piston 10 in such a way that the piston 10 is displaceably arranged in the cylinder housing 7, wherein this protrudes, i.e. completely penetrates beyond the cylinder housing 7 both at its upper axial end 8 and at its lower axial end 9 in each operating state. In this way, a high degree of stability is produced, which is given when the piston 10 moves relative to the cylinder housing 7.

Figure 2:
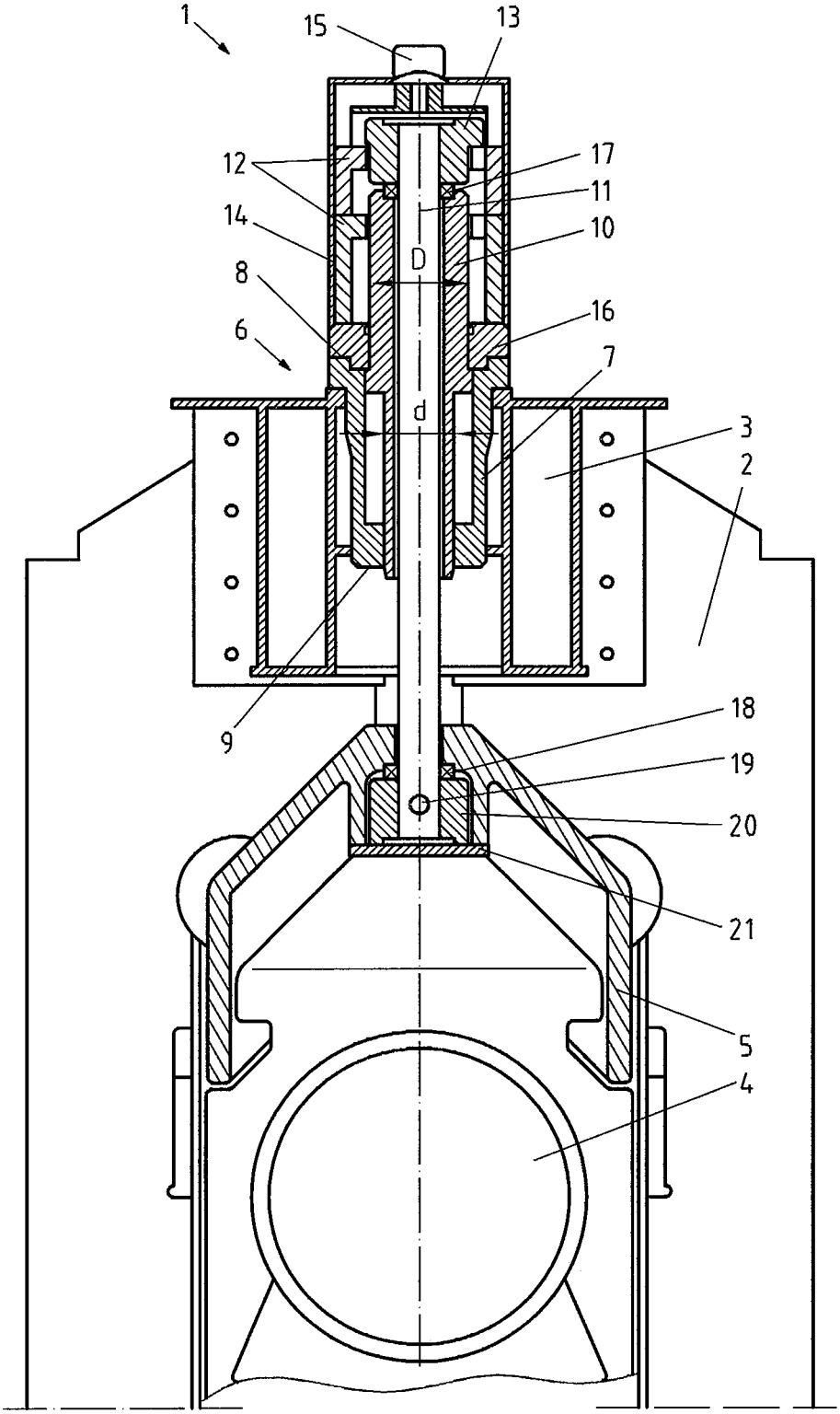

It can best be seen from FIG. 2 that the piston 10 has an outer diameter D in its upper region which is greater than the outer diameter d of the piston 10 in its lower region. As a result, a hydraulic chamber is formed in the interior of the piston-cylinder system 6, to which hydraulic fluid can be applied.

The piston 10 is hollow and is penetrated by a pull rod 11. The pull rod 11 is connected above the piston 10 at its upper axial end to the piston 10 in a lockable manner. At its lower axial end, the pull rod 11 is connected to the balancing cross-member 5.

In the exemplary embodiment, the locking mechanism comprises a locking sleeve 12, a locking piece 13, a cover hood 14 and a pivot drive 15. The pull rod 11 can be locked or unlocked with the upper end of the piston 10 by a pivot movement of the pivot drive 15.

A pivot bearing 17 is placed between the locking piece 13 and the piston 10. The cover hood 14 ensures that the moving parts are not accessible from the outside; accordingly there is no risk of accident.

The pull rod 11 is connected to the balancing cross-member 5 by means of a pivot bearing 18, an end piece 20, an anti-rotation device 19 and a cover 21.

An essential element of the proposed construction is therefore the completely penetrating (in particular hollow) piston 10 which penetrates the cylinder housing and which is safely guided even with large openings, i.e. with a large cylinder stroke. The pull rod 11 is guided through the piston 10 and fastened with its lower end to the balancing cross-member 5. The connections between the pull rod and the adjacent components are articulated (by means of axial pivot bearings 17 and 18). This reduces the stress on the cylinder from the rolling process; the cylinder can be exchanged with little effort. The balancing cross-member and the pull rods can remain in the scaffolding for this purpose.

Due to the compact design, a closed stage construction can be achieved, which is necessary for scaffolding types with extraction (for non-ferrous metals and stainless steel). The effort for this is significantly reduced. Due to the integrated design, no moving parts are accessible, which means that measures to shut off the balancing (e.g. using fences) can be omitted. Additional devices for locking the balancing can also be omitted.

The cylinders can be serviced and exchanged with little effort, without having to dismantle the balancing cross-member and the pull rods. The compact design also enables the flexible arrangement of components on the scaffolding platform (e.g. drive components for mechanical adjustment and valve stands).

LIST OF REFERENCE SIGNS

1 rolling mill
2 roller stands
3 stand cross-member
4 roller
5 balancing cross-member
6 piston-cylinder system
7 cylinder housing
8 upper axial end of the cylinder housing
9 lower axial end of the cylinder housing
10 pistons
11 pull rod
12, 13,
14, 15 locking mechanism
12 locking sleeve
13 locking piece
14 cover hood
15 pivot drive
16 cylinder cover
17 pivot bearing
18 pivot bearing
19 anti-rotation device
20 end piece
21 cover
M central plane of the roller stand
D first external diameter of the piston
d second external diameter of the piston

The invention claimed is:

1. A rolling mill for rolling metal products, comprising:

two roller stands with a stand cross-member, wherein a roller is rotatably mounted in the roller stands, wherein the roller is operatively connected to a balancing cross-member, and wherein at least one hydraulic piston-cylinder system is arranged in the stand cross-member, with which a tensile force can be generated between the stand cross-member and the balancing cross-member, wherein the piston-cylinder system has a cylinder housing with an upper axial end and a lower axial end, wherein a piston is movably arranged in the cylinder housing, and wherein the piston protrudes beyond the cylinder housing both at the upper axial end thereof and at the lower axial end thereof, during an operating state, wherein the connection between the stand cross-member and the balancing cross-member is established via a pull rod that is connected to the piston and the balancing cross-member, wherein the pull rod is releasably connected to the piston, wherein a locking mechanism is provided for the releasable connection.

2. The rolling mill according to claim 1, wherein two piston-cylinder systems are arranged symmetrically to a central plane of the roller stands.

3. The rolling mill according to claim 1, wherein the piston has a first external diameter in an upper section, wherein the piston has a second external diameter in a lower section which is smaller than the first external diameter.

4. The rolling mill according to claim 1, wherein the pull rod passes axially through the piston and is fastened to the piston in an upper region thereof.

5. The rolling mill according to claim 1, wherein the locking mechanism is arranged on the cylinder housing.

6. The rolling mill according to claim 1, wherein the locking mechanism comprises a pivot drive which causes locking or unlocking by a pivot movement.

7. The rolling mill according to claim 1, wherein the locking mechanism comprises a cover hood which covers the locking mechanism inaccessible from the outside.

8. The rolling mill according to claim 1, wherein it is a roughing mill stand or a heavy plate rolling mill in a hot rolling mill.

9. The rolling mill according to claim 2, wherein the piston has a first external diameter in an upper section, wherein the piston has a second external diameter in a lower section which is smaller than the first external diameter.

10. The rolling mill according to claim 2, wherein the connection between the stand cross-member and the balancing cross-member is established via a pull rod that is connected to the piston and the balancing cross-member.

11. The rolling mill according to claim 5, wherein the locking mechanism comprises a pivot drive which causes locking or unlocking by a pivot movement.

12. The rolling mill according to claim 5, wherein the locking mechanism comprises a cover hood which covers the locking mechanism inaccessible from the outside.

13. The rolling mill according to claim 6, wherein the locking mechanism comprises a cover hood which covers the locking mechanism inaccessible from the outside.

14. The rolling mill according to claim 2, wherein it is a roughing mill stand or a heavy plate rolling mill in a hot rolling mill.

15. The rolling mill according to claim 3, wherein it is a roughing mill stand or a heavy plate rolling mill in a hot rolling mill.

16. The rolling mill according to claim 4, wherein it is a roughing mill stand or a heavy plate rolling mill in a hot rolling mill.

* * * * *